US011060464B2

(12) United States Patent
Christensen et al.

(10) Patent No.: US 11,060,464 B2
(45) Date of Patent: Jul. 13, 2021

(54) METHODS AND SYSTEM FOR STOPPING AND STARTING A VEHICLE

(71) Applicant: Ford Global Technologies, LLC, Dearborn, MI (US)

(72) Inventors: M. Scott Christensen, Canton, MI (US); Michael Bastanipour, Ferndale, MI (US); David Hancock, Flat Rock, MI (US); Alexander O'connor Gibson, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 343 days.

(21) Appl. No.: 16/271,652

(22) Filed: Feb. 8, 2019

(65) Prior Publication Data

US 2020/0256262 A1 Aug. 13, 2020

(51) Int. Cl.

| | |
|---|---|
| ***G06G 7/70*** | (2006.01) |
| ***F02D 17/02*** | (2006.01) |
| ***F02M 59/10*** | (2006.01) |
| ***F02P 5/04*** | (2006.01) |
| ***F02N 11/04*** | (2006.01) |
| ***F02D 41/00*** | (2006.01) |
| ***F02D 13/02*** | (2006.01) |
| ***F02N 19/00*** | (2010.01) |

(52) U.S. Cl.

CPC ..... *F02D 17/02* (2013.01); *F02D 13/0203* (2013.01); *F02D 41/0002* (2013.01); *F02M 59/102* (2013.01); *F02N 11/04* (2013.01); *F02N 19/005* (2013.01); *F02P 5/045* (2013.01); *F02D 2200/06* (2013.01); *F02N 2019/008* (2013.01); *F02N 2200/021* (2013.01)

(58) Field of Classification Search

CPC .. F02D 17/02; F02D 13/0203; F02D 41/0002; F02D 2200/06; F02M 59/102; F02N 11/04; F02N 19/005; F02N 2019/008; F02N 2200/021; F02P 5/045

USPC ..... 701/112

See application file for complete search history.

(56) References Cited

U.S. PATENT DOCUMENTS

| | | | | |
|---|---|---|---|---|
| 7,269,499 | B2 | 9/2007 | Murakami et al. | |
| 8,423,271 | B2 * | 4/2013 | Gibson | F02N 11/0814 701/112 |
| 9,222,453 | B2 * | 12/2015 | Gibson | F02D 41/0002 |
| 2009/0118991 | A1 * | 5/2009 | Ueda | F02D 41/3836 701/112 |
| 2011/0246046 | A1 | 10/2011 | Ichinose et al. | |
| 2015/0025780 | A1 * | 1/2015 | Gibson | F02D 41/065 701/105 |

* cited by examiner

*Primary Examiner* — Hung Q Nguyen
*Assistant Examiner* — Anthony Donald Taylor, Jr.
(74) *Attorney, Agent, or Firm* — Geoffrey Brumbaugh; McCoy Russell LLP

(57) ABSTRACT

Systems and methods for operating an internal combustion engine are described. In one example, an engine's position is adjusted during engine stopping so that the engine may be less likely to stop at a crankshaft angle where rotating a fuel pump may increase engine cranking torque due to work performed by the fuel pump.

20 Claims, 5 Drawing Sheets

METHODS AND SYSTEM FOR STOPPING AND STARTING A VEHICLE

FIELD

The present description relates to methods and a system for stopping and starting an engine that includes a belt integrated starter/generator.

BACKGROUND AND SUMMARY

A vehicle may include a belt integrated starter/generator (BISG) to start an internal combustion engine and to charge a battery. The BISG may also provide torque to the engine when the engine is operating (e.g., combusting fuel and rotating) to boost driveline output. The BISG and its accompanying battery may be sized to provide robust engine starting when the engine stops at a position that requires a larger amount of torque to rotate the engine in a forward direction and to achieve a cranking speed that is sufficient for engine starting during cold ambient conditions. However, such a BISG may not be cost effective for some engine applications. Therefore, it may be desirable to provide a way of starting an engine with a reduced amount of torque so that a smaller BISG and battery may reliably start an engine without having a large excess torque capacity.

The inventors herein have recognized the above-mentioned issues and have developed an engine operating method, comprising: deactivating one or more cylinders of an engine via a controller in response to a request to stop the engine; and reactivating the one or more cylinders of the engine via the controller in response to an estimated engine stopping position at which a fuel pump is in its compression stroke.

By reactivating one or more deactivated cylinders after an engine stop request and before the engine stops, it may be possible to provide the technical result of adjusting an engine stopping position so that the engine does not stop during a compression stroke of a direct injection fuel pump. Accordingly, the engine may be stopped during an intake stroke or while the fuel pump is rotating about a base circle of a direct fuel injection pump cam so that the engine may be rotated using less BISG torque. Consequently, the engine may be started with a BISG and/or battery having less capacity. The engine's inertia may be used to overcome engine cylinder piston compression and fuel pump compression once the engine begins to rotate via the BISG.

The present description may provide several advantages. Specifically, the approach may improve engine starting robustness. In addition, the approach may reduce system cost by enabling robust engine starting via a BISG with lower torque output capacity. Further, the approach may reduce BISG belt wear by the engine stopping at a desired position without having to use BISG torque to rotate the engine. Further still, the possibility of lapses in BISG belt tension and belt disengagement that may be caused via a BISG controlling engine stopping position may be reduced.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

The present description is related to controlling engine stopping to improve the possibility of engine starting via a BISG. In particular, the present description is related to adjusting an engine stopping position via reactivating one or more deactivated cylinders to achieve a desired engine stopping position when an estimated engine stopping position is coincident with a compression stroke of a fuel injection pump. Further, adjusting the engine stopping position may enable robust engine starting via a BISG with lower output torque capacity. The engine may be of the type shown in FIG. 1. The engine may be included in a driveline of the type shown in FIG. 2. The engine may include a fuel pump of the type illustrated in FIG. 3. The engine may be stopped according to the sequence shown in FIG. 4. The engine may be operated according to the method of FIG. 5.

Figure 1:
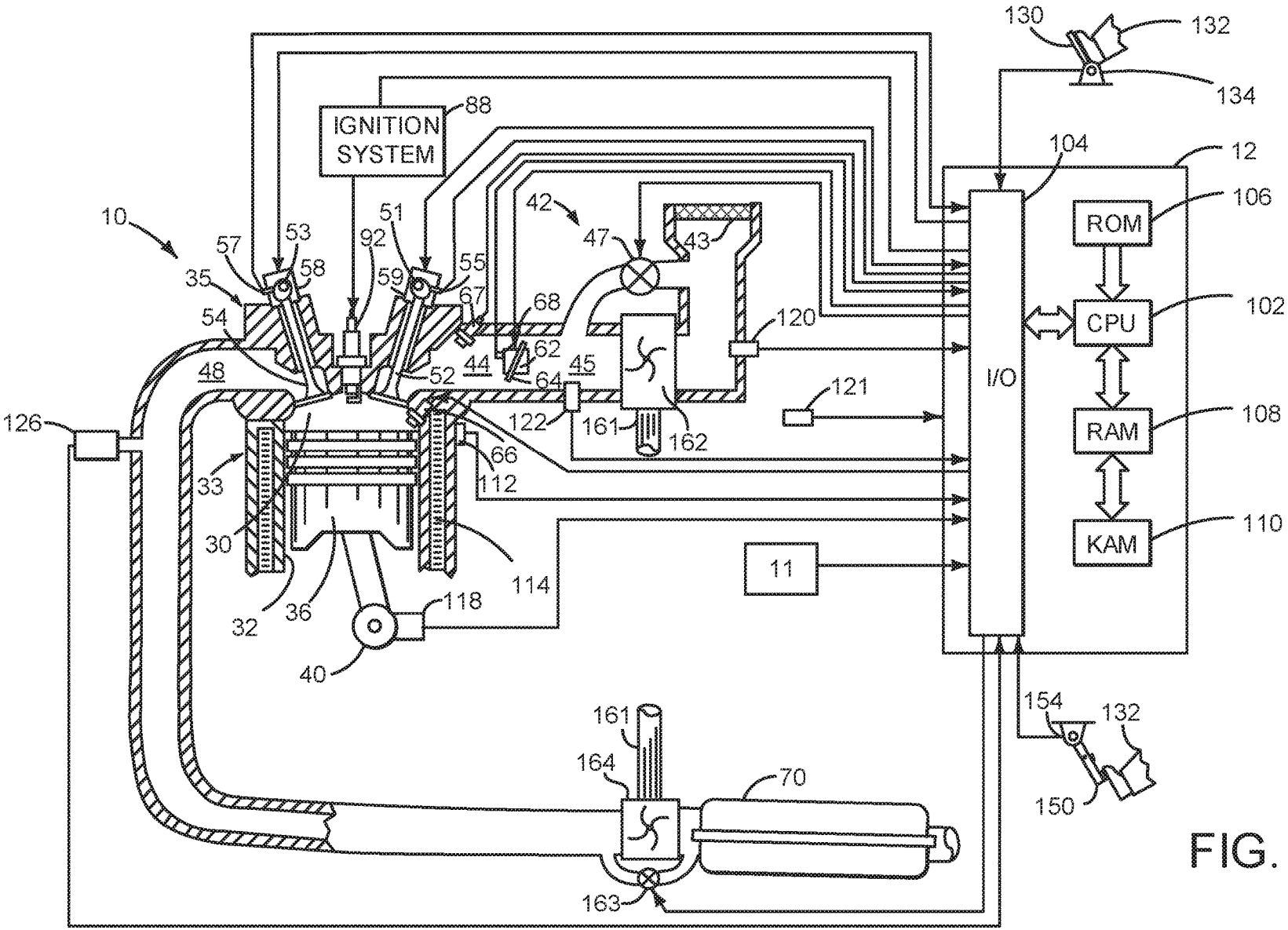
FIG. 1 is a schematic diagram of an engine.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1 and 2 and employs the actuators shown in FIGS. 1 and 2 to adjust engine and driveline operation based on the received signals and instructions stored in memory of controller 12.

Engine 10 is comprised of cylinder head 35 and block 33, which include combustion chamber 30 and cylinder walls 32. Piston 36 is positioned therein and it reciprocates via a connection to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Timing of intake valve 52 may be adjusted relative to crankshaft 40 via cam phasing device 59. Timing of exhaust valve 54 may be adjusted relative to crankshaft 40 via cam phasing device 58.

Direct fuel injector 66 is shown positioned to inject fuel directly into cylinder 30, which is known to those skilled in the art as direct injection. Port fuel injector 67 is shown positioned to inject fuel into the intake port of cylinder 30, which is known to those skilled in the art as port injection. Fuel injectors 66 and 67 deliver liquid fuel in proportion to pulse widths provided by controller 12. Fuel is delivered to fuel injectors 66 and 67 by a fuel system (not shown) including a fuel tank, fuel pump, and fuel rail shown in FIG. 3.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of three-way catalyst 70. Alternatively, a two-state exhaust gas oxygen sensor may be substituted for UEGO sensor 126.

Catalyst 70 can include multiple bricks and a three-way catalyst coating, in one example. In another example, multiple emission control devices, each with multiple bricks, can be used.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 (e.g., a human/machine interface) for sensing force applied by human driver 132; a position sensor 154 coupled to brake pedal 150 (e.g., a human/machine interface) for sensing force applied by human driver 132, a measurement of engine manifold pressure (MAP) from pressure sensor 122 coupled to intake manifold 44; barometric pressure from barometric pressure sensor 121; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start the engine or vehicle may be generated via a human and input to the human/machine interface 11. The human/machine interface 11 may be a touch screen display, pushbutton, key switch or other known input/output device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
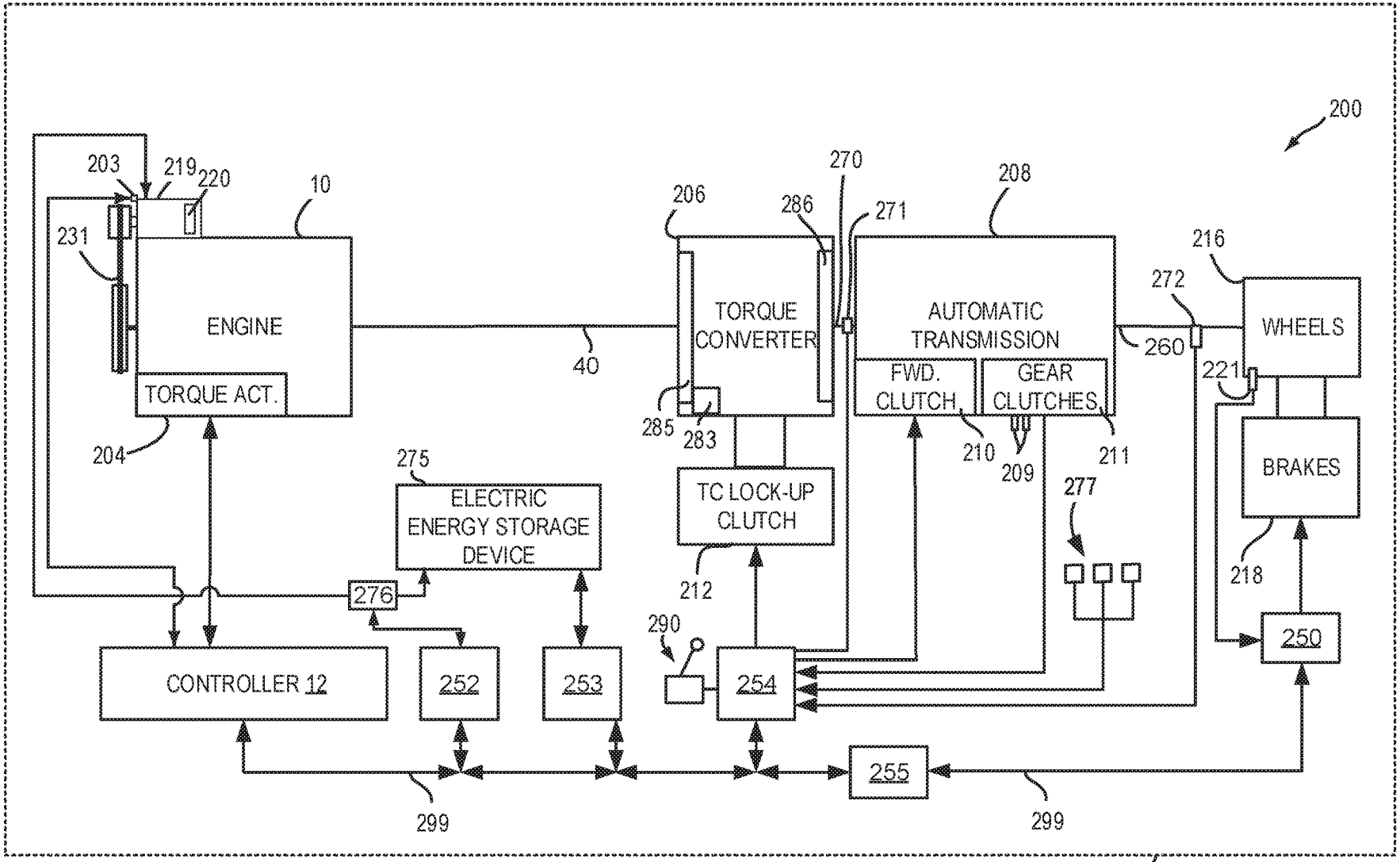
FIG. 2 is a schematic diagram of a vehicle driveline.

FIG. 2 is a block diagram of a vehicle 225 including a powertrain or driveline 200. The powertrain of FIG. 2 includes engine 10 shown in FIG. 1. Powertrain 200 is shown including vehicle system controller 255, engine controller 12, electric machine controller 252, transmission controller 254, energy storage device controller 253, and brake controller 250. The controllers may communicate over controller area network (CAN) 299. Each of the controllers may provide information to other controllers such as power output limits (e.g., power output of the device or component being controlled not to be exceeded), power input limits (e.g., power input of the device or component being controlled not to be exceeded), power output of the device being controlled, sensor and actuator data, diagnostic information (e.g., information regarding a degraded transmission, information regarding a degraded engine, information regarding a degraded electric machine, information regarding degraded brakes). Further, the vehicle system controller 255 may provide commands to engine controller 12, electric machine controller 252, transmission controller 254, and brake controller 250 to achieve driver input requests and other requests that are based on vehicle operating conditions.

For example, in response to a driver releasing an accelerator pedal and vehicle speed, vehicle system controller 255 may request a desired wheel power or a wheel power level to provide a desired rate of vehicle deceleration. The requested desired wheel power may be provided by vehicle system controller 255 requesting a first braking power from electric machine controller 252 and a second braking power from engine controller 212, the first and second powers providing a desired driveline braking power at vehicle wheels 216. Vehicle system controller 255 may also request a friction braking power via brake controller 250. The braking powers may be referred to as negative powers since they slow driveline and wheel rotation. Positive power may maintain or accelerate driveline and wheel rotation.

In other examples, the partitioning of controlling powertrain devices may be partitioned differently than is shown in FIG. 2. For example, a single controller may take the place of vehicle system controller 255, engine controller 12, electric machine controller 252, transmission controller 254, and brake controller 250. Alternatively, the vehicle system controller 255 and the engine controller 12 may be a single unit while the electric machine controller 252, the transmission controller 254, and the brake controller 250 are standalone controllers.

In this example, powertrain 200 may be powered by engine 10 and belt integrated starter/generator (BISG) 219. Engine 10 may be started via BISG 219. A speed of BISG 219 may be determined via optional BISG speed sensor 203. BISG 219 may also be referred to as an electric machine, motor, and/or generator. Further, power of engine 10 may be adjusted via power actuator 204, such as a fuel injector, throttle, etc. Electric machine controller 252 may operate BISG 219 in a generator mode or a motor mode via commanding inverter 276. The inverter 276 may convert direct current (DC) from the electric energy storage device 275 into alternating current (AC) to power the BISG 219. Alternatively, the inverter 276 may convert alternating current into direct current to charge the electric energy storage device 275.

BISG 219 is mechanically coupled to engine 10 via belt 231. BISG 219 may be coupled to crankshaft 40 or a camshaft (e.g., 51 or 53 of FIG. 1). BISG 219 may operate as a motor when supplied with electrical power via electric energy storage device 275 via inverter 276. BISG 219 may operate as a generator supplying electrical power to electric energy storage device 275 via inverter 276.

An engine output power and BISG output power may be transmitted to torque converter turbine 286, which outputs engine power to transmission input shaft 270. Transmission input shaft 270 mechanically couples torque converter 206 to automatic transmission 208. Torque converter 206 also includes a torque converter bypass lock-up clutch 212 (TCC). Power is directly transferred from impeller 285 to turbine 286 when TCC is locked. TCC is electrically operated by controller 12. Alternatively, TCC may be hydraulically locked. In one example, the torque converter may be referred to as a component of the transmission.

When torque converter lock-up clutch 212 is fully disengaged, torque converter 206 transmits engine power to automatic transmission 208 via fluid transfer between the torque converter turbine 286 and torque converter impeller 285, thereby enabling power multiplication. In contrast, when torque converter lock-up clutch 212 is fully engaged, the engine output power is directly transferred via the torque converter clutch to an input shaft 270 of transmission 208. Alternatively, the torque converter lock-up clutch 212 may be partially engaged, thereby enabling the amount of power directly relayed to the transmission to be adjusted. The transmission controller 254 may be configured to adjust the amount of power transmitted by torque converter 212 by adjusting the torque converter lock-up clutch in response to various engine operating conditions, or based on a driver-based engine operation request.

Torque converter 206 also includes pump 283 that pressurizes fluid to operate forward clutch 210 and gear clutches 211. Pump 283 is driven via impeller 285, which rotates at a same speed as engine crankshaft 40.

Automatic transmission 208 includes gear clutches (e.g., gears 1-10) 211 and forward clutch 210. Automatic transmission 208 is a fixed ratio transmission. Alternatively, transmission 208 may be a continuously variable transmission that has a capability of simulating a fixed gear ratio transmission and fixed gear ratios. The gear clutches 211 and the forward clutch 210 may be selectively engaged to change a ratio of an actual total number of turns of input shaft 270 to an actual total number of turns of wheels 216. Gear clutches 211 may be engaged or disengaged via adjusting fluid supplied to the clutches via shift control solenoid valves 209. Power output from the automatic transmission 208 may also be relayed to wheels 216 to propel the vehicle via output shaft 260. Specifically, automatic transmission 208 may transfer an input driving power at the input shaft 270 responsive to a vehicle traveling conditions before transmitting an output driving power to the wheels 216. Transmission controller 254 selectively activates or engages TCC 212, gear clutches 211, and forward clutch 210. Transmission controller also selectively deactivates or disengages TCC 212, gear clutches 211, and forward clutch 210.

Further, a frictional force may be applied to wheels 216 by engaging friction wheel brakes 218. In one example, friction wheel brakes 218 may be engaged in response to a human driver pressing their foot on a brake pedal (not shown) and/or in response to instructions within brake controller 250. Further, brake controller 250 may apply brakes 218 in response to information and/or requests made by vehicle system controller 255. In the same way, a frictional force may be reduced to wheels 216 by disengaging wheel brakes 218 in response to the human driver releasing their foot from a brake pedal, brake controller instructions, and/or vehicle system controller instructions and/or information. For example, vehicle brakes may apply a frictional force to wheels 216 via controller 250 as part of an automated engine stopping procedure.

In response to a request to accelerate vehicle 225, vehicle system controller may obtain a driver demand power or power request from an accelerator pedal or other device. Vehicle system controller 255 then allocates a fraction of the requested driver demand power to the engine and the remaining fraction to the BISG 219. Vehicle system controller 255 requests the engine power from engine controller 12 and the BISG power from electric machine controller 252. If the BISG power plus the engine power is less than a transmission input power limit (e.g., a threshold value not to be exceeded), the power is delivered to torque converter 206 which then relays at least a fraction of the requested power to transmission input shaft 270. Transmission controller 254 selectively locks torque converter clutch 212 and engages gears via gear clutches 211 in response to shift schedules and TCC lockup schedules that may be based on input shaft power and vehicle speed. In some conditions when it may be desired to charge electric energy storage device 275, a charging or regeneration power (e.g., a negative BISG power) may be requested while a non-zero driver demand power is present. Vehicle system controller 255 may request increased engine power to overcome the charging power to meet the driver demand power.

In response to a request to decelerate vehicle 225, vehicle system controller 255 may provide a negative desired wheel power (e.g., desired or requested powertrain wheel power) based on vehicle speed and brake pedal position. Vehicle system controller 255 then allocates a fraction of the negative desired wheel power to the BISG 219 and the engine 10. Vehicle system controller may also allocate a portion of the requested braking power to friction brakes 218 (e.g., desired friction brake wheel power). Further, vehicle system controller may notify transmission controller 254 that the vehicle is in regenerative braking mode so that transmission controller 254 shifts gears 211 based on a unique shifting schedule to increase regeneration efficiency. Engine 10 and BISG 219 may supply a negative power to transmission input shaft 270, but negative power (e.g., power absorbed from the driveline) provided by BISG 219 and engine 10 may be limited by transmission controller 254 which outputs a transmission input shaft negative power limit (e.g., not to be exceeded threshold value). Further, negative power of BISG 219 may be limited (e.g., constrained to less than a threshold negative threshold power) based on operating conditions of electric energy storage device 275, by vehicle system controller 255, or electric machine controller 252. Any portion of desired negative wheel power that may not be provided by BISG 219 because of transmission or BISG limits may be allocated to engine 10 and/or friction brakes 218 so that the desired wheel power is provided by a combination of negative power (e.g., power absorbed) via friction brakes 218, engine 10, and BISG 219.

Accordingly, power control of the various powertrain components may be supervised by vehicle system controller 255 with local power control for the engine 10, transmission 208, BISG 219, and brakes 218 provided via engine controller 12, electric machine controller 252, transmission controller 254, and brake controller 250.

As one example, an engine power output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine power output by controlling a combination of fuel pulse width, fuel pulse timing, and air charge. Engine braking power or negative engine power may be provided by rotating the engine with the engine generating power that is insufficient to rotate the engine. Thus, the engine may generate a braking power via operating at a low power while combusting fuel, with one or more cylinders deactivated (e.g., not combusting fuel), or with all cylinders deactivated and while rotating the engine. The amount of engine braking power may be adjusted via adjusting engine valve timing. Engine valve timing may be adjusted to increase or decrease engine compression work. Further, engine valve timing may be adjusted to increase or decrease engine expansion work. In all cases, engine control may be performed on a cylinder-by-cylinder basis to control the engine power output.

Electric machine controller 252 may control power output and electrical energy production from BISG 219 by adjusting current flowing to and from field and/or armature windings 220 of BISG as is known in the art.

Transmission controller 254 receives transmission input shaft position via position sensor 271. Transmission controller 254 may convert transmission input shaft position into input shaft speed via differentiating a signal from position sensor 271 or counting a number of known angular distance pulses over a predetermined time interval. Transmission controller 254 may receive transmission output shaft torque from torque sensor 272. Alternatively, sensor 272 may be a position sensor or torque and position sensors. If sensor 272 is a position sensor, controller 254 may count shaft position pulses over a predetermined time interval to determine transmission output shaft velocity. Transmission controller 254 may also differentiate transmission output shaft velocity to determine transmission output shaft acceleration. Transmission controller 254, engine controller 12, and vehicle system controller 255, may also receive addition transmission information from sensors 277, which may include but are not limited to pump output line pressure sensors, transmission hydraulic pressure sensors (e.g., gear clutch fluid pressure sensors), BISG temperature sensors, and BISG temperatures, gear shift lever sensors, and ambient temperature sensors. Transmission controller 254 may also receive requested gear input from gear shift selector 290 (e.g., a human/machine interface device). Gear shift lever may include positions for gears 1-N (where N is an upper gear number), D (drive), and P (park).

Brake controller 250 receives wheel speed information via wheel speed sensor 221 and braking requests from vehicle system controller 255. Brake controller 250 may also receive brake pedal position information from brake pedal sensor 154 shown in FIG. 1 directly or over CAN 299. Brake controller 250 may provide braking responsive to a wheel power command from vehicle system controller 255. Brake controller 250 may also provide anti-lock and vehicle stability braking to improve vehicle braking and stability. As such, brake controller 250 may provide a wheel power limit (e.g., a threshold negative wheel power not to be exceeded) to the vehicle system controller 255 so that negative BISG power does not cause the wheel power limit to be exceeded. For example, if controller 250 issues a negative wheel power limit of 10 N-m, BISG power is adjusted to provide less than 10 N-m (e.g., 9 N-m) of negative power at the wheels, including accounting for transmission gearing.

Thus, the system of FIGS. 1 and 2 provides for a system, comprising: an engine including a belt integrated starter/generator (BISG) and a crankshaft; a fuel pump mechanically driven via the engine; and a controller including executable instructions stored in non-transitory memory to deactivate one or more cylinders of the engine via the controller in response to a request to stop the engine, and reactivate the one or more cylinders of the engine via the controller before the engine stops in response to an estimated engine stopping position at which the fuel pump is on its compression stroke. The system further comprises additional instructions to not reactivate the one or more cylinders in response to the estimated engine stopping position being a location at which the fuel pump is not on its compression stroke. The system further comprises additional instructions to rotate the engine via the BISG in response to a request to start the engine. The system further comprises a solenoid valve in fluidic communication with the fuel pump.

Figure 3:
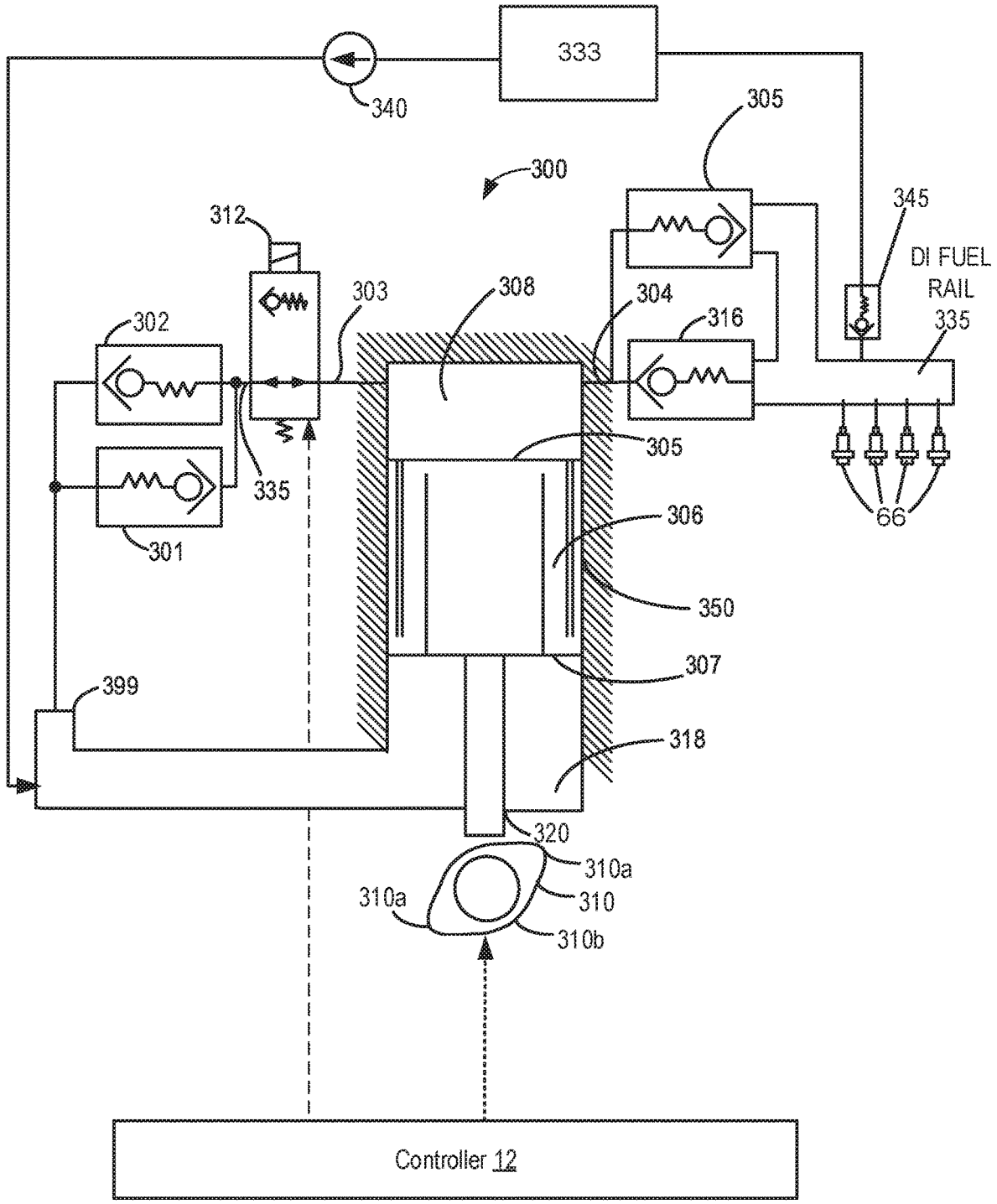
FIG. 3 is a schematic diagram of an example direct injection fuel pump.

Referring now to FIG. 3, a non-limiting example direct injection fuel pump 300 is shown. Inlet 303 of direct injection fuel pump compression chamber 308 is supplied fuel via a low pressure fuel pump 340. Fuel is supplied to low pressure fuel pump 340 via fuel tank 333. The fuel may be pressurized upon its passage through direct injection fuel pump 300 and supplied to fuel rail 335 through pump outlet 304. In the depicted example, direct injection pump 300 may be a mechanically-driven displacement pump that includes a pump piston 306 and piston rod 320, a pump compression chamber 308 (herein also referred to as compression chamber), and a step-room 318. Piston 306 includes a top 305 and a bottom 307. The step-room and compression chamber may include cavities positioned on opposing sides of the pump piston. In one example, engine 10 may be configured to drive the piston 306 in direct injection pump 300 by driving cam 310. Cam 310 is shown including two lobes and the cam completes one rotation for every two engine crankshaft rotations. However, cam 310 may include a different actual total number of lobes (e.g., 1, 3, or 4). Cam 310 may be driven via crankshaft 40, exhaust cam 53, or intake cam 51. Cam 310 includes two lobes 310*a* that provide a height or lift increase of the cam profile for vertically moving rod 320 and piston 306 to produce compression and suction strokes.

Cam 310 also includes a base circle (zero cam lift) 310*b* where the cam rotates without vertically moving rod 320 and piston 306.

A solenoid activated inlet check valve 312 may be coupled to pump inlet 303. Controller 12 may be configured to regulate fuel flow through inlet check valve 312 by energizing or de-energizing the solenoid valve (based on the solenoid valve configuration) in synchronism with engine position and the direct fuel injection cam. Accordingly, solenoid activated inlet check valve 312 may be operated in two modes. In a first mode, solenoid activated check valve 312 is positioned within inlet 303 to limit (e.g. inhibit) the amount of fuel traveling upstream of the solenoid activated check valve 312. In comparison, in the second mode, solenoid activated check valve 312 is effectively disabled and fuel can travel upstream and downstream of inlet check valve.

As such, solenoid activated check valve 312 may be configured to regulate the mass of fuel compressed into the direct injection fuel pump. In one example, controller 12 may adjust an opening time and a closing timing of the solenoid activated check valve to regulate the mass of fuel compressed. For example, a late inlet check valve closing may reduce the amount of fuel mass ingested into the compression chamber 308. The solenoid activated check valve opening and closing timings may be coordinated with respect to stroke timings of the direct injection fuel pump and the engine. By continuously throttling the flow into the direct injection fuel pump from the low pressure fuel pump, fuel may be ingested into the direct injection fuel pump without requiring metering of the fuel mass.

Pump inlet 399 allows fuel to flow to check valve 302 and pressure relief valve 301. Check valve 302 is positioned upstream of solenoid activated check valve 312 along passage 335. Check valve 302 is biased to prevent fuel flow out of solenoid activated check valve 312 and pump inlet 399. Check valve 302 allows flow from the low pressure fuel pump to solenoid activated check valve 312. Check valve 302 is coupled in parallel with pressure relief valve 301. Pressure relief valve 301 allows fuel flow out of solenoid activated check valve 312 toward the low pressure fuel pump when pressure between pressure relief valve 301 and solenoid operated check valve 312 is greater than a predetermined pressure (e.g., 10 bar). When solenoid operated check valve 312 is deactivated (e.g., not electrically energized), solenoid operated check valve operates in a pass-through mode and pressure relief valve 301 regulates pressure in compression chamber 308 to the single pressure relief setting of pressure relief valve 301 (e.g., 15 bar). Regulating the pressure in compression chamber 308 allows a pressure differential to form from piston top 305 to piston bottom 307. The pressure in step-room 318 is at the pressure of the outlet of the low pressure pump (e.g., 5 bar) while the pressure at piston top is at pressure relief valve regulation pressure (e.g., 15 bar). The pressure differential allows fuel to seep from piston top 305 to piston bottom 307 through the clearance between piston 306 and pump cylinder wall 350, thereby lubricating direct injection fuel pump 300.

Piston 306 reciprocates up and down. Direct fuel injection pump 300 is in a compression stroke when piston 306 is traveling in a direction that reduces the volume of compression chamber 308. Direct fuel injection pump 300 is in a suction stroke when piston 306 is traveling in a direction that increases the volume of compression chamber 308.

A forward flow outlet check valve 316 may be coupled downstream of an outlet 304 of the compression chamber 308. Outlet check valve 316 opens to allow fuel to flow from the compression chamber outlet 304 into fuel rail 435 only when a pressure at the outlet of direct injection fuel pump 300 (e.g., a compression chamber outlet pressure) is higher than the fuel rail pressure. Thus, during conditions when direct injection fuel pump operation is not requested, controller 12 may deactivate solenoid activated inlet check valve 312 and pressure relief valve 301 regulates pressure in compression chamber to a single substantially constant (e.g., regulation pressure±0.5 bar) pressure. Controller 12 simply deactivates solenoid activated check valve 312 to lubricate direct injection fuel pump 300. One result of this regulation method is that the fuel rail is regulated to approximately the pressure relief of 302. Thus, if valve 302 has a pressure relief setting of 10 bar, the fuel rail pressure becomes 15 bar because this 10 bar adds to the 5 bar of lift pump pressure. Specifically, the fuel pressure in compression chamber 308 is regulated during the compression stroke of direct injection fuel pump 300. Thus, during at least the compression stroke of direct injection fuel pump 300, lubrication is provided to the pump. When direct fuel injection pump enters a suction stroke, fuel pressure in the compression chamber may be reduced while still some level of lubrication may be provided as long as the pressure differential remains. The fuel rail supplies fuel to fuel injectors 66 and relief valve 345 returns fuel to fuel tank 433 if pressure in the fuel rail exceeds a desired pressure.

Figure 4:
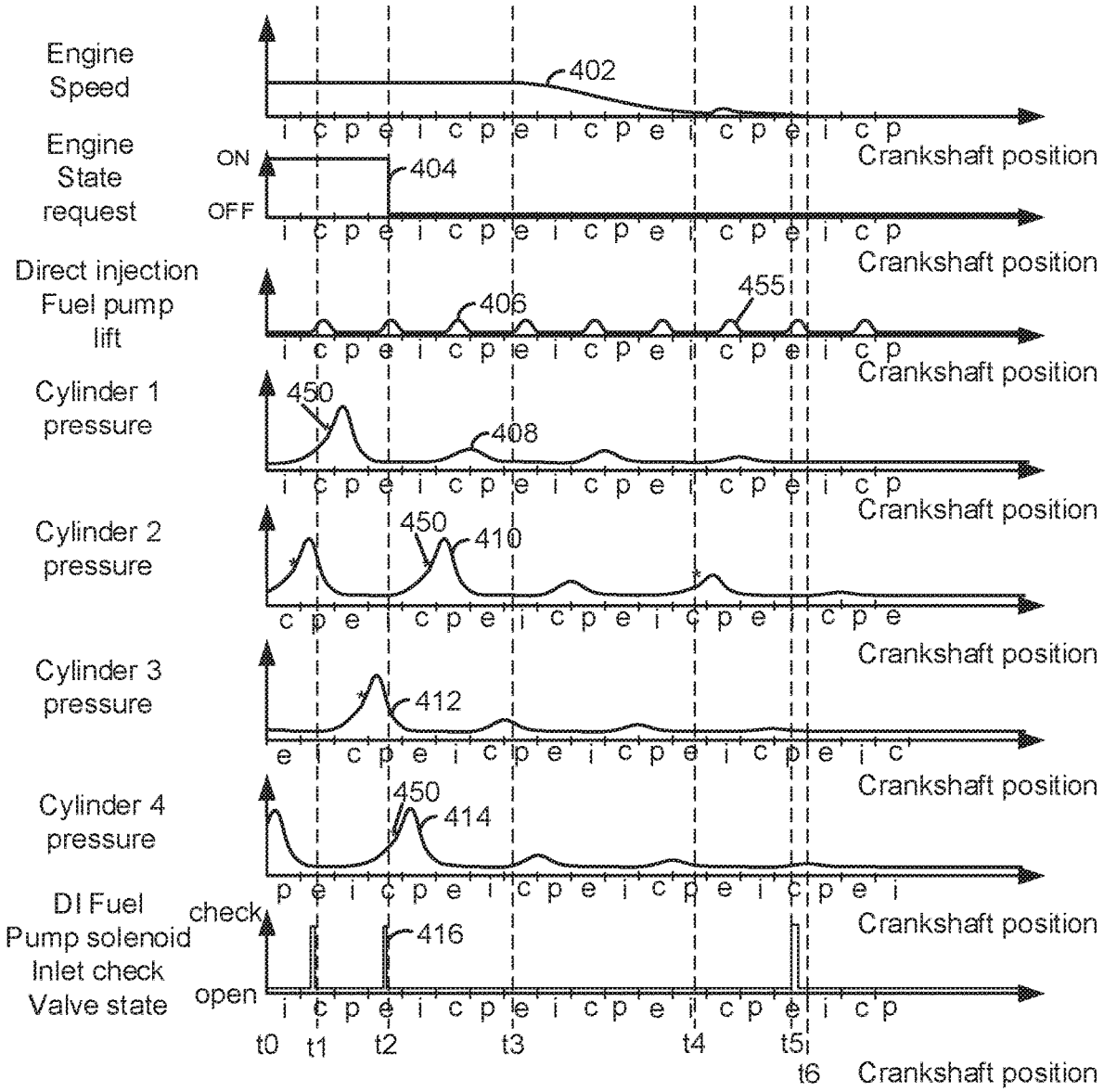
FIG. 4 shows an example engine operating sequence according to the method of FIG. 5.
Figure 5:
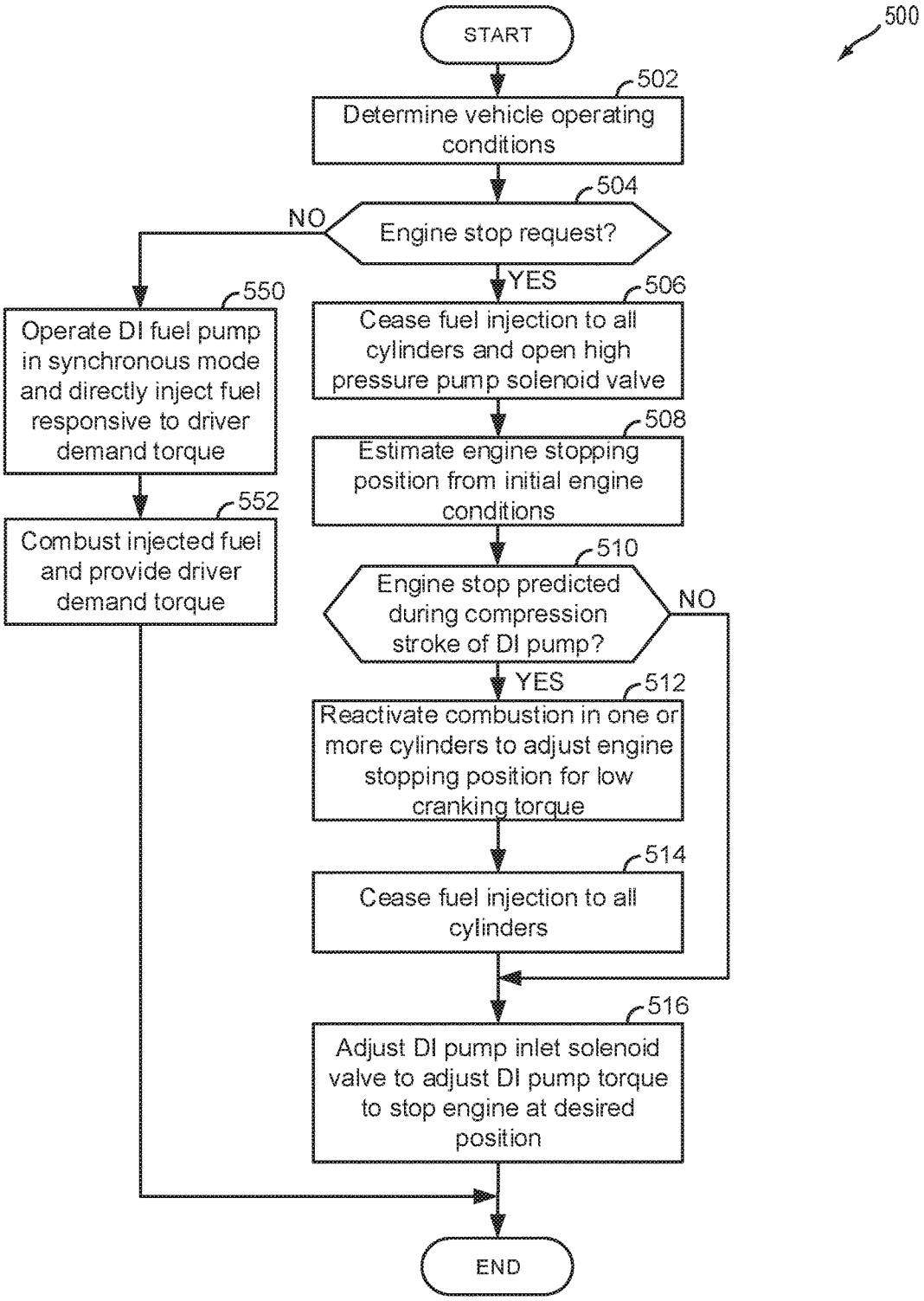
FIG. 5 shows a method for operating an engine.

Referring now to FIG. 4, plots of a prophetic engine operating sequence according to the method of FIG. 5 and the system of FIGS. 1 and 2 are shown. The plots are aligned in time and occur at a same time. The vertical lines at t0-t46 show events at particular times of interest. The engine operating sequence is for a four cylinder four stroke engine having a firing order of 1-3-4-2 and a direct fuel injection pump having two lobes. Each horizontal axis of each plot is shown referenced to strokes of the respective cylinders, except for the first, second, third and eighth plots, which are not shown referenced to the strokes of cylinder number one. The * marks 450 near the cylinder pressure traces indicate ignition (spark) events for the individual cylinders described by the cylinder pressure plots.

The first plot from the top of FIG. 4 is a plot of engine crankshaft rotational speed versus stroke of cylinder number one. The vertical axis represents engine speed and engine speed increases in the direction of the vertical axis arrow. The horizontal axis represents engine crankshaft position relative to cylinder number one. Trace 402 represents the engine speed.

The second plot from the top of FIG. 4 is a plot of an engine start request state versus stroke of cylinder number one. The engine start request is asserted when trace 404 is at a higher level near the vertical axis arrow. The engine is being started or is already running when trace 404 is at the higher level. The engine start request is not asserted when trace 404 is at a lower level near the horizontal axis. The horizontal axis represents engine crankshaft position relative to cylinder number one. Trace 404 represents the engine start request state.

The third plot from the top of FIG. 4 is a plot of direct injection fuel pump cam lobe position versus stroke of cylinder number one. The direct fuel injector lobe trace 406 indicates that the direct fuel injection pump is on a compression stroke when the height of trace 406 is increasing in the direction of the vertical axis arrow. The direct fuel injector lobe trace 406 indicates that the direct fuel injection pump is on a suction stroke when the height of trace 406 is decreasing in the direction opposite of the vertical axis arrow. The horizontal axis represents engine crankshaft position relative to cylinder number one. Trace 406 represents the direct fuel injector lobe position. The lobe provides a greater amount of lift to move the piston and reduce the compression chamber volume as the height of trace 406 increases in the direction of the vertical axis arrow.

The fourth plot from the top of FIG. 4 is a plot of pressure in cylinder number one versus time. The pressure in cylinder number one increases in the direction of the vertical axis arrow. The horizontal axis represents the strokes of cylinder number one and the small vertical lines along the horizontal axis represent top-dead-center and bottom dead-center locations for cylinder number one. Trace 408 represents pressure in cylinder number one.

The fifth plot from the top of FIG. 4 is a plot of pressure in cylinder number two versus time. The pressure in cylinder number two increases in the direction of the vertical axis arrow. The horizontal axis represents the strokes of cylinder number two and the small vertical lines along the horizontal axis represent top-dead-center and bottom dead-center locations for cylinder number two. Trace 410 represents pressure in cylinder number two.

The sixth plot from the top of FIG. 4 is a plot of pressure in cylinder number three versus time. The pressure in cylinder number three increases in the direction of the vertical axis arrow. The horizontal axis represents the strokes of cylinder number three and the small vertical lines along the horizontal axis represent top-dead-center and bottom dead-center locations for cylinder number three. Trace 412 represents pressure in cylinder number three.

The seventh plot from the top of FIG. 4 is a plot of pressure in cylinder number four versus time. The pressure in cylinder number four increases in the direction of the vertical axis arrow. The horizontal axis represents the strokes of cylinder number four and the small vertical lines along the horizontal axis represent top-dead-center and bottom dead-center locations for cylinder number four. Trace 414 represents pressure in cylinder number four.

The eighth plot from the top of FIG. 4 is a plot of the direct injection fuel pump solenoid activated inlet check valve operating state versus time. The solenoid activated inlet check valve is energized or activated when trace 316 is at a higher level indicated by "check." The solenoid activated inlet check valve is deactivated or not energized when trace 316 is at a lower level indicated by "open." The horizontal axis represents engine crankshaft position relative to cylinder number one. Trace 416 represents solenoid activated inlet check valve operating state.

At time t0, the engine is operating (e.g., rotating and combusting fuel) as indicated by the engine start request being asserted. The engine speed is at a lower middle level (e.g., idle speed) and the fuel pump is rotating as the engine rotates. The pressures in each of the cylinders are rising in part due to combustion in all of the cylinders. The direct injection fuel pump solenoid activated inlet check valve is being opened and closed synchronously with the engine crankshaft rotation.

At time t1, the direct injection fuel pump solenoid activated inlet check valve is commanded into the check position so that maximum flow through the direct injection fuel pump is generated for at least a portion of the compression stroke of the direct injection fuel pump. The direct injection fuel pump solenoid activated inlet check valve is commanded to the check state when the direct fuel injection pump is on a compression stroke. The direct injection fuel pump sends pressurized fuel to the fuel rail (not shown) when the solenoid activated inlet check valve is in the check state while the direct fuel injection pump is on its compression stroke. The engine speed continues at its previous level and the engine is still commanded on. The cylinder pressures continue to increase and decrease as the engine rotates.

At time t2, the engine is commanded off (e.g., not combusting) in response to an automatic engine stop request or a request by the vehicle's driver (not shown). Fuel flow to all of the engine cylinders is ceased and the engine throttle is closed (not shown), but fuel injections that are in progress may complete. The fuel pump continues to rotate as the engine begins to decelerate. The direct injection fuel pump solenoid activated inlet check valve is commanded to the open state so that fuel flow through the direct injection pump ceases and pumping torque of the direct injection fuel pump is reduced. Shortly after time t2, ignition is initiated in cylinders four and two to combust the last fuel injections made into cylinder numbers two and three after the engine stop request.

At time t3, the engine begins to decelerate since fuel injection to the cylinders has ceased. The engine "off" state is still requested and the direct fuel injection pump continues to rotate as the engine decelerates. Pressures in the cylinders decline as intake manifold pressure decreases due to the engine throttle being closed at time t2. The direct injection fuel pump solenoid activated inlet check valve remains in the open state so fuel is not pumped by the direct injection fuel pump, thereby generating little compression work via the direct fuel injection pump.

At time t4, cylinder number two is reactivated via injecting fuel into cylinder number two (not shown) and igniting the air-fuel mixture in cylinder number two. Cylinder number two is reactivated temporarily so that the engine rotates through the direct injection pump compression stroke 455 instead of stopping during the compression stroke 455, which may have required higher engine cranking torques to rotate the engine as compared to if the engine stops at the crankshaft angle indicated at time t6. One or more cylinders may be temporarily reactivated when the controller estimates that the engine stopping position is not a desired engine stopping position (e.g., an engine crankshaft angle where the direct fuel injection pump is not on its compression stroke). Thus, if the estimated engine stopping position is an engine crankshaft angle where the direct fuel injection pump is on a compression stroke, then one or more cylinders may be reactivated to adjust the engine stopping position. The cylinder charge (e.g., air and fuel amounts) in cylinder number two may be adjusted responsive to the crankshaft angular distance the engine needs to rotate from the crankshaft position at time t4 to the crankshaft position at time t6 so that the engine may reach the desired crankshaft position shown at time t6 (e.g., between direct injection pump compression strokes). The combustion event at time t4 causes the engine to accelerate and then engine speed declines again. The direct injection fuel pump solenoid activated inlet check valve remains in an open position and the engine state request remains "off."

At time t5, the engine speed is decreasing, but the controller estimates that the engine will stop after time t6. Therefore, the direct injection fuel pump solenoid activated inlet check valve is commanded activated at time t5, thereby increasing the fuel pump compression work and decelerating the engine so that the engine stops at time t6 in the desired engine stopping position (e.g., a crankshaft angle where the direct fuel injection pump is rotating on its base circle and not raising the direct fuel injection pump piston). The engine state request remains "off" and the engine speed reaches zero at time t6.

In this way, one or more engine cylinders may be reactivated when an estimated engine stopping position is a crankshaft angle where a direct fuel injector pump is on its compression stroke so that when the engine is subsequently cranked for starting, the torque to rotate the engine may be less than if the engine stopped at a crankshaft location where the direct fuel injection pump is on its compression stroke.

Referring now to FIG. 5, a flow chart of a method for operating an engine to reduce engine cranking torque requirements is shown. The method of FIG. 5 may be incorporated into and may cooperate with the system of FIGS. 1 and 2. Further, at least portions of the method of FIG. 5 may be incorporated as executable instructions stored in non-transitory memory while other portions of the method may be performed via a controller transforming operating states of devices and actuators in the physical world. Method 500 may be executed when engine 10 of FIG. 1 is operating (e.g., combusting fuel and rotating).

At 502, method 500 determines vehicle operating conditions. Vehicle operating conditions may include but are not limited to vehicle speed, engine speed, engine temperature, electric energy storage device state of charge (SOC), barometric pressure, and accelerator pedal position, engine pumping work, engine friction, engine crankshaft position, and air charge in each engine cylinder. Method 500 proceeds to 504.

At 504, method 500 judges if an engine stop request is present. An engine stop may be generated via the human driver, or alternatively, the engine stop request may be generated automatically via the controller 12 responsive to vehicle operating conditions and without input from a human driver to stop the engine via a dedicated input that has a sole purpose of starting and/or stopping the engine (e.g., a key switch or pushbutton). A request to stop the engine may be generated automatically via controller 12 in response to driver demand torque being less than a threshold torque. Further, additional conditions may be required to request an engine stop automatically (e.g., battery state of charge being greater than a threshold). If method 500 judges that an engine stop is requested, then the answer is yes and method 500 proceeds to 506. Further, fuel delivery and spark delivery to the engine may be ceased to stop the engine. If method 500 judges that an engine stop is not requested, the answer is no and method 500 proceeds to 550.

At 550, method 400 commands the direct injection fuel pump solenoid activated inlet check valve to operate in synchronous mode so that the direct injection fuel pump solenoid activated inlet check valve is activated during a compression stroke of the direct fuel injection pump and open when the direct fuel injection pump is not on a compression stroke. This allows the direct injection fuel pump to flow high pressure fuel to the direct fuel injectors. The fuel injectors and throttle are opened and closed responsive to driver demand torque (e.g., accelerator pedal position). Method 500 proceeds to 552.

At 552, method 500 combusts the injected fuel and generates the requested driver demand torque. The combustion byproducts are then delivered to an after treatment system for processing. Method 500 proceeds to exit.

At 506, method 500 ceases injecting fuel to all engine cylinders, though fuel injections that are in progress may be completed. In addition, method 500 ignites the remaining air-fuel mixtures in the cylinders so that the injected fuel is combusted before the fuel may be ejected to the engine exhaust system as the engine decelerates. In addition, the direct injection fuel pump solenoid activated inlet check valve is commanded full open so that the direct injection pump ceases to supply fuel to the direct injector fuel rail. This may prevent higher fuel pressures than may be desired from being stored in the fuel rail and it may also conserve electrical power. Method 500 proceeds to 508.

At 508, method 500 estimates the engine stopping position according to vehicle operating conditions. In one example, method 500 estimates the engine's kinetic energy after fuel injection is ceased and after the last combustion event after most recently ceasing fuel injection. The engine's kinetic energy may be estimated by the following equation:

$$KE=\tfrac{1}{2}I\omega^2$$

where KE is the engine's kinetic energy, I is the engine's inertia, and ω is engine speed. The kinetic energy may then be adjusted at predetermined crankshaft intervals responsive to engine friction and pumping work and the engine crankshaft angle where the engine's kinetic energy is zero may be the engine's estimated engine stopping position. For example, a vector of engine crankshaft angles may be generated beginning at a crankshaft angle where fuel injection to the last cylinder after engine deactivation is requested. Alternatively, the vector may begin at a crankshaft angle where the engine speed is reduced to less than a threshold speed (e.g., 300 RPM). The vector may include entries for the amount of estimated engine kinetic energy at predetermined crankshaft angular intervals (e.g., every six crankshaft degrees) based on the initial engine conditions at which entries in the vector begins (e.g., engine speed that is less than the threshold speed or a predetermined crankshaft angle after the last combustion event after most recently ceasing fuel injection). The engine kinetic energy values in the vector at each crankshaft interval may be adjusted based on engine friction and engine pumping work. In other examples, the engine stopping position may be determined in other known ways. Method 500 proceeds to 510.

At 510, method 500 judges if the estimated or predicted engine stopping position determined at 508 is an engine crankshaft position where the direct fuel injector fuel pump is on a compression stroke. In one example, a table or function stored in controller memory contains crankshaft angles where the direct fuel injector is on its compression stroke. If method 500 judges that the estimated engine stopping position is a position where the direct fuel injector pump is on a compression stroke, then the answer is yes and method 500 proceeds to 512. Otherwise, the answer is no and method 500 proceeds to 516.

At 512, method 500 reactivates one or more engine cylinders to adjust the estimated engine stopping position. The engine cylinder is reactivated by supplying spark and fuel to the engine. The charge (e.g., air and fuel amounts) may be adjusted depending on the angular crankshaft distance between top-dead-center compression stroke of the cylinder being activated and the desired engine stopping position (e.g., a crankshaft angle where the fuel injection pump's rod is in contact with the base circle of the fuel injection pump cam). In particular, the throttle may be opened farther when the engine needs to rotate further to reach its desired or requested engine stopping position. Further, the amount of fuel injected may be increased when the engine needs to rotate further to reach its desired or requested engine stopping position. In addition, spark timing may be advanced further and poppet valve timing relative to crankshaft position may be adjusted when the engine needs to rotate further to reach its desired or requested engine stopping position. In one example, the cylinder charge and spark timing may be adjusted as a function of crankshaft angular distance from the present engine position to the desired engine stopping position. The cylinder charge and spark timing adjustments may be empirically determined via performing several engine stops and adjusting cylinder charge and spark timing to meet the desired engine stopping position. Tables or functions stored in controller memory may contain the empirically determined values for adjusting spark advance and cylinder charge. In this way, torque of the reactivated cylinders may be adjusted. Method 500 reactivates the one or more cylinders and adjusts the charge and spark timing of the reactivated cylinders, then method 500 proceeds to 514.

At 514, method 500 deactivates the one or more cylinders that were reactivated at 512 via ceasing to supply fuel to the reactivated cylinders. Method 500 proceeds to 516.

At 516, method 500 adjusts the operating state of the direct injection fuel pump solenoid activated inlet check valve. If the engine is approaching a requested or desired stopping location at a speed that is greater than desired, the direct injection fuel pump solenoid activated inlet check valve may be activated to increase the work required to move the direct injection fuel pump piston through its compression stroke. A portion of the engine's kinetic energy may be consumed via the pumping work that is performed by the direct injection fuel pump so that the engine's speed may be reduced so that the engine stops at the desired engine stopping position. Method 500 proceeds to exit.

Additionally, in some examples, method 500 may rotate the engine via the BISG after the engine is stopped and in response to a request to start the engine. Thus, at 516, method 500 may wait until an engine start request is generated and the engine is restarted via the BISG after the engine is stopped before method 500 exits.

In this way, the engine stopping position may be adjusted to a desired or requested engine stopping position so that the engine does not rest at a crankshaft angle where the direct fuel injection pump is on its compression stroke. Rather, the engine may be stopped at a crankshaft angle where the fuel pump's rod is on the direct fuel injection pump cam's base circle so that the initial amount of torque to rotate the engine during a restart may be reduced.

Thus, the method of FIG. 5 provides for an engine operating method, comprising: deactivating one or more cylinders of an engine via a controller in response to a request to stop the engine; and reactivating the one or more cylinders of the engine via the controller in response to an estimated engine stopping position at which a fuel pump is in its compression stroke. The method includes where the fuel pump is driven via the engine. The method includes where deactivating the one or more cylinders includes ceasing to supply fuel to the one or more cylinders. The method includes where reactivating the one or more cylinders includes supplying fuel to the one or more cylinders. The method further comprises adjusting torque provided via the one or more reactivated cylinders in response to a crankshaft angle distance to a desired engine stopping position. The method includes where adjusting torque includes adjusting spark timing. The method includes where adjusting torque includes adjusting poppet valve timing. The method includes where adjusting torque includes adjusting a throttle opening amount.

The method of FIG. 5 also provides for an engine operating method, comprising: deactivating one or more cylinders of an engine via a controller in response to a request to stop the engine; estimating an engine stopping position based on engine position at which fuel injection to the one or more cylinders is deactivated in response to the request to stop the engine; and reactivating the one or more cylinders of the engine via the controller in response to an estimated engine stopping position at which a fuel pump is in its compression stroke. The method includes where the estimated engine stopping position is further based on engine speed. The method includes where the estimated engine stopping position is further based on engine friction. The method includes where the estimated engine stopping position is further based on engine pumping work. The method further comprises rotating the engine and starting the engine via a belt integrated starter/generator in response to an engine start request after stopping the engine. The method further comprises adjusting torque of the one or more reactivated cylinders based on a requested engine stopping position. The method further comprises not reactivating the one or more cylinders in response the estimated engine stopping position being at location where the fuel pump is not on its compression stroke.

In another representation, the method of FIG. 5 provides for an engine operating method, comprising: deactivating one or more cylinders of an engine via a controller in response to a request to stop the engine; and adjusting an operating state of a direct injection fuel pump solenoid activated inlet check valve in response to a desired or requested engine stopping position where a direct fuel injection pump is not on its compression stroke. Where the direct injection fuel pump solenoid activated inlet check valve is adjusted to increase an amount of pumping work of a direct injection fuel pump. In addition, one or more engine cylinders may be reactivated in response to the desired or requested engine stopping position.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. An engine operating method, comprising:

deactivating at least one cylinder of an engine via a controller in response to a request to stop the engine; and reactivating the at least one cylinder of the engine via the controller in response to an estimated engine stopping position at which a fuel pump is in its compression stroke.

2. The method of claim 1, where the fuel pump is driven via the engine.

3. The method of claim 1, where deactivating the at least one cylinder includes ceasing to supply fuel to the at least one cylinder.

4. The method of claim 1, where reactivating the at least one cylinder includes supplying fuel to the at least one cylinder.

5. The method of claim 1, further comprising adjusting a torque provided via the reactivated at least one cylinder in response to a crankshaft angle distance to a desired engine stopping position.

6. The method of claim 5, where adjusting the torque includes adjusting a spark timing.

7. The method of claim 5, where adjusting the torque includes adjusting a poppet valve timing.

8. The method of claim 5, where adjusting the torque includes adjusting a throttle opening amount.

9. An engine operating method, comprising:

deactivating at least one cylinder of an engine via a controller in response to a request to stop the engine;

estimating an engine stopping position based on engine conditions at which fuel injection to the at least one cylinder of the engine is deactivated in response to the request to stop the engine; and reactivating the at least one cylinder of the engine via the controller in response to the estimated engine stopping position being at a location at which a fuel pump is in its compression stroke.

10. The method of claim 9, where the estimated engine stopping position is further based on engine speed.

11. The method of claim 10, where the estimated engine stopping position is further based on engine friction.

12. The method of claim 11, where the estimated engine stopping position is further based on engine pumping work.

13. The method of claim 9, further comprising rotating and starting the engine via a belt integrated starter/generator in response to a request to start the engine.

14. The method of claim 9, further comprising adjusting a torque of the reactivated at least one cylinder based on a requested engine stopping position.

15. The method of claim 9, further comprising not reactivating the at least one cylinder in response to the estimated engine stopping position being at a location where the fuel pump is not in its compression stroke.

16. A system, comprising:

an engine including a belt integrated starter/generator (BISG) and a crankshaft;

a fuel pump mechanically driven by the engine; and a controller including executable instructions stored in non-transitory memory, the controller configured to deactivate at least one cylinder of the engine in response to a request to stop the engine, estimate an engine stopping position based on engine conditions, and reactivate the at least one cylinder of the engine in response to the estimated engine stopping position being at a location at which the fuel pump is in its compression stroke.

17. The system of claim 16, where the controller further comprises additional instructions to not reactivate the at least one cylinder in response to the estimated engine stopping position being at a location at which the fuel pump is not in its compression stroke.

18. The system of claim 17, where the controller further comprises additional instructions to rotate the engine via the BISG in response to a request to start the engine.

19. The system of claim 16, further comprising a solenoid valve in fluidic communication with the fuel pump.

20. The system of claim 19, where the controller further comprises additional instructions to operate the solenoid valve synchronously with a rotation of the engine.

* * * * *